US007182608B2

(12) United States Patent
Soh et al.

(10) Patent No.: US 7,182,608 B2
(45) Date of Patent: Feb. 27, 2007

(54) CHESSBOARD ELECTRICAL CONNECTOR

(75) Inventors: Vivienne Pei Yeen Soh, Singapore (SG); Man Sang Lai, Singapore (SG); Chung Ling Loke, Signapore (SG)

(73) Assignee: Amphenol Corporation, Wallingford, CT (US)

( * ) Notice: Subject to any disclaimer, the term of this patent is extended or adjusted under 35 U.S.C. 154(b) by 0 days.

(21) Appl. No.: 11/172,935

(22) Filed: Jul. 5, 2005

(65) Prior Publication Data

US 2007/0010108 A1 Jan. 11, 2007

(51) Int. Cl.
*H01R 12/00* (2006.01)
*H01R 13/60* (2006.01)

(52) U.S. Cl. ..... 439/74; 439/540.1

(58) Field of Classification Search ..... 439/284, 439/74, 540.1

See application file for complete search history.

(56) References Cited

U.S. PATENT DOCUMENTS

| | | | | |
|---|---|---|---|---|
| 2,125,816 | A | 8/1938 | Reynolds | |
| 2,663,007 | A | 12/1953 | Diessl | |
| D184,294 | S | 1/1959 | Swan | |
| 3,461,258 | A | 8/1969 | Schlesinger, Jr. | |
| 3,478,296 | A | 11/1969 | Schmitt | |
| 3,827,007 | A | 7/1974 | Fairbarn | |
| 5,098,311 | A * | 3/1992 | Roath et al. | 439/74 |
| 5,224,866 | A * | 7/1993 | Nakamura et al. | 439/660 |
| 5,306,171 | A | 4/1994 | Marshall | |
| 5,498,167 | A * | 3/1996 | Seto et al. | 439/284 |
| 5,915,975 | A * | 6/1999 | McGrath | 439/74 |
| 5,941,722 | A | 8/1999 | Chen | |
| 6,045,371 | A * | 4/2000 | Kagawa et al. | 439/74 |
| 6,077,121 | A * | 6/2000 | Wu | 439/74 |
| 2004/0171285 | A1 * | 9/2004 | Okura | 439/74 |

FOREIGN PATENT DOCUMENTS

| | | |
|---|---|---|
| FR | 2 290 056 | 5/1976 |

* cited by examiner

*Primary Examiner*—Briggitte R. Hammond
(74) *Attorney, Agent, or Firm*—Blank Rome LLP

(57) ABSTRACT

An electrical connector for a printed circuit board that has a main body including a printed circuit board engaging surface, a first socket disposed on the main body, the first socket including a first section extending from the main body opposite the printed circuit board engaging surface, and a plurality of first contacts each having opposite first and second ends. A first plug is spaced from the first socket and has a plurality of second contacts each having opposite first and second ends. The first ends of each of the first and second contacts extending in substantially the same direction from a first side of the main body and being adapted to engage the printed circuit board. Each of the second ends of the first and second contacts being exposed and including a catching surface for engaging a contact of a mating connector.

24 Claims, 3 Drawing Sheets

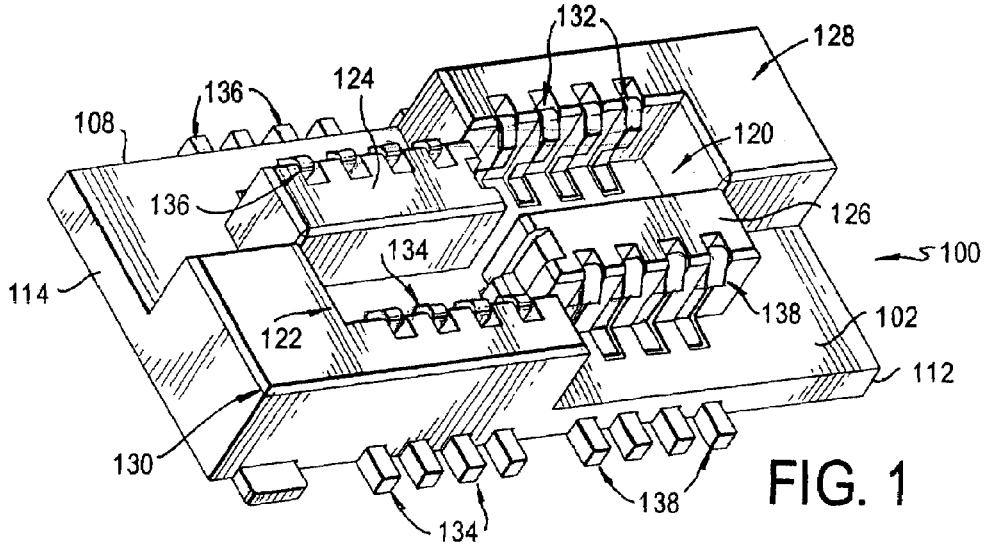
FIG. 1
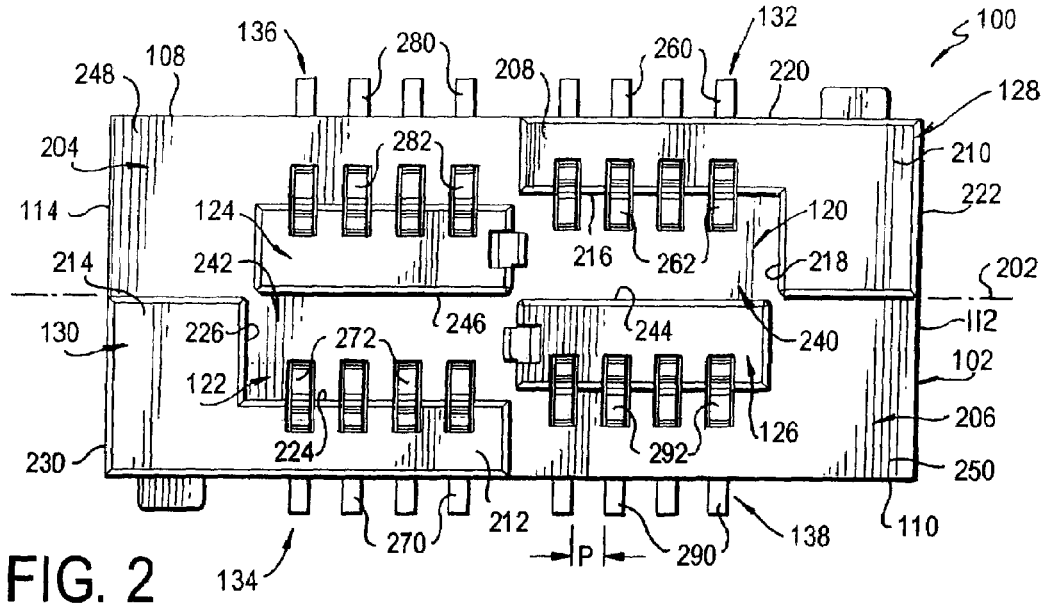
FIG. 2
FIG. 3
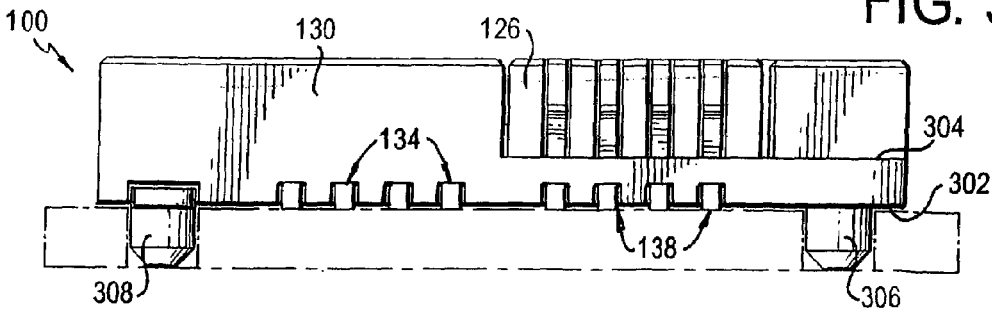

CHESSBOARD ELECTRICAL CONNECTOR

FIELD OF THE INVENTION

The present invention relates to a hermaphroditic connector for mating one printed circuit board to another. More specifically, the connector includes alternating plug and socket features that engage corresponding plug and socket features of an identical connector.

BACKGROUND OF THE INVENTION

Electrical connectors for mating more than one circuit board to connect multiple systems together are well known. Typically male and female type connectors are used to connect one board to another. Often mating the male and female connectors is difficult because the connectors must be precisely oriented in order to properly mate. Moreover, the use of different connectors, such as male and female connectors, increases manufacturing costs. Additionally, these connectors are often bulky and occupy valuable space on the printed circuit board.

Examples of conventional electrical connectors include U.S. Pat. No. 5,306,171 to Marshall, U.S. Pat. No. 3,827,007 to Fairbairn et al., U.S. Pat. No. 3,478,296 to Schmitt, and U.S. Pat. No. 3,461,258 to Shlesinger, Jr., the subject matter of each of which is hereby incorporated by reference.

SUMMARY OF THE INVENTION

Accordingly, it is an object of the invention to provide an electrical connector for mating more than one board that is less costly, more compact and easier to use than conventional electrical connectors for mating boards.

The foregoing object is basically attained by an electrical connector for a printed circuit board that has a main body including a printed circuit board engaging surface, a first socket disposed on the main body, the first socket including a first section extending from the main body opposite the printed circuit board engaging surface, and a plurality of first contacts each having opposite first and second ends. A first plug is spaced from the first socket and has a plurality of second contacts each having opposite first and second ends. The first ends of each of the first and second contacts extending in substantially the same direction from a first side of the main body and being adapted to engage the printed circuit board. Each of the second ends of the first and second contacts being exposed and including a catching surface for engaging a contact of a mating connector.

The foregoing objects are also attained by an electrical connector assembly that has first and second printed circuit boards, and first and second substantially identical connectors mounted to the first and second printed circuit boards, respectively. Each of the first and second connectors including a main body, and a first socket and a first plug extending from a surface of the main body opposite the respective first and second printed circuit boards. The first socket and the first plug include a plurality of first and second contacts, respectively. Each of the first and second contacts include opposite first and second ends. The first ends of the first and second contacts of the first connector extend in substantially the same direction from a first side of the main body of the first connector and engage the first printed circuit board. The first ends of the first and second contacts of the second connector extend in substantially the same direction from a first side of the main body of the second connector and engage the second printed circuit board. The second ends of the first contacts of the first socket of the first connector engaging the second ends of the second contacts of the first plug of the second connector. The second ends of the second contacts of the first plug of the first connector engaging the second ends of the first contacts of the first socket of the second connector, thereby electrically connecting the first and second printed circuit boards.

Other objects, advantages and salient features of the invention will become apparent from the following detailed description, which, taken in conjunction with the annexed drawings, discloses preferred embodiments of the present invention.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein:

FIG. 1 is a perspective view of an electrical connector according to the present invention;

FIG. 2 is a top plan view of the electrical connector illustrated in FIG. 1;

FIG. 3 is a side elevational view of the electrical connector illustrated in FIG. 1;

DETAILED DESCRIPTION OF THE INVENTION

Figure 4:
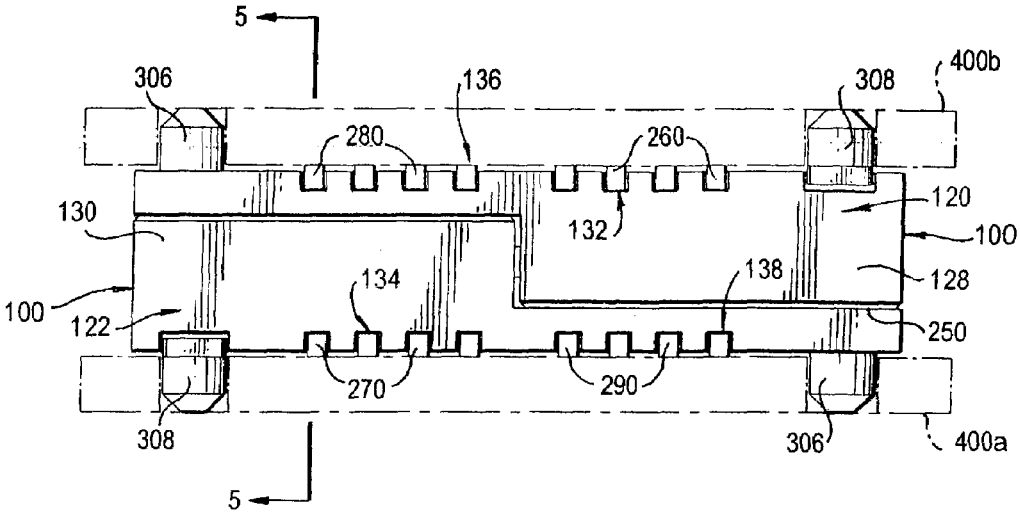
FIG. 4 is a side elevational view of two mated electrical connectors in accordance with the present invention.

Referring to FIGS. 1–8, the present invention generally relates to an electrical connector 100 for mechanically and electrically connecting more than one printed circuit board 400*a* and 400*b* (FIG. 4). The connector 100 is preferably hermaphroditic, that is it includes both socket and plug features, and the plug and socket features alternate so that two of the connectors 100 (FIG. 4) can be used to connect the boards without regard to mating orientation of the connectors. Because the connectors 100 are identical, only one connector is described. Additionally, the connector 100 is compact with finer pitch contacts than conventional connectors, thereby reducing the amount of space occupied by the connector on the circuit board.

As seen in FIGS. 1–3, connector 100 generally includes first and second sockets 120 and 122, first and second plugs 124 and 126, first and second sets of socket contacts 132 and 134, and first and second plug contacts 136 and 138.

A main body 102 of connector 100 is substantially flat and includes a first surface 302 (FIG. 3) that rests on the printed circuit board and a second surface 304 opposite first surface 302 that defines a connection interface for the second substantially identical connector. The main body 102 includes first and second sides 108 and 110, first and second ends 112 and 114 extending between the sides 108 and 110, and a central longitudinal axis 202 (FIG. 2) dividing the connector 100 into two identical halves 204 and 206. Two alignment posts 306 and 308 extend from the first surface 302 of the main body 102 along its central longitudinal axis 202 that are received in corresponding openings in the circuit board. An interference fit can be optionally provided between the posts 306 and 308 and the respective openings in the circuit board to provide a secure attached to the board.

First and second sockets 120 and 122 and first and second plugs 124 and 126 are disposed on the connection interface 304 of the main body 102 opposite the first surface 302. First and second sockets 120 and 122 include first and second L-shaped members 128 and 130, respectively. As seen in FIG. 2, first L-shaped member 128 has first and second sections 208 and 210 and second L-shaped member 130 has first and second sections 212 and 214. The first and second sections 208 and 210 of the first L-shaped member 128 include inner surfaces 216 and 218 and outer surfaces 220 and 222. Likewise the first and second sections 212 and 214 of the second L-shaped member 130 include inner surfaces 224 and 226, and outer surfaces 228 and 230. The outer surfaces 220 and 22 of the first L-shaped member 128 are generally flush with the first side 108 and the first end 112, respectively, of the main body 102. The outer surfaces 228 and 230 of the second L-shaped member 130 are generally flush with the second side 110 and the second end 114 of the main body.

As seen in FIGS. 1 and 2, the L-shaped members 128 and 130 of the first and second sockets 120 and 122 are disposed at two opposite corners of the main body 102 of connector 100. First plug 124 is spaced from the first section 212 of the second L-shaped member 130 of second socket 122 opposite its inner surface 224. Similarly, second plug 126 is spaced from the first section 208 of the first L-shaped member 128 of the first socket 120, opposite its inner surface 216.

First and second cavities 240 and 242 are defined between the L-shaped members 128 and 130 and the plugs 124 and 126. First cavity 240 is defined by the inner surfaces 216 and 218 of the L-shaped member 128 of the first socket 120 and the inner surface 244 of second plug 126. Second cavity 242 is defined between the inner surfaces 224 and 226 of the L-shaped member 130 of the second socket 122 and the inner surface 246 of the first plug 124. First and second L-shaped spaces 248 and 250 are disposed at the two opposite corners not occupied by L-shaped members 128 and 130. The first and second cavities 240 and 242 are adapted to receive the first and second plugs of the identical mating connector 100 and the first and second L-shaped spaces 248 and 250 are adapted to receive the first and second sockets of the identical mating connector 100, thereby connecting the two circuit boards 400*a* and 400*b* (FIG. 4).

First and second sets of socket contacts 132 and 134 of connector 100 are supported by first and second sockets 120 and 122, respectively, and first and second sets of plug contacts 136 and 138 are supported by first and second plugs 124 and 126, as seen in FIG. 1. Preferably, each set of socket contacts 132 and 134 and plug contacts 136 and 138 include four contacts with a pitch p (FIG. 2, the distance between two adjacent contacts), that is less than 0.5 mm, such as 0.4 mm or 0.3 mm. Alternatively, any number of contacts with a pitch less than, equal to, or greater than 0.5 mm can also be used.

Figure 5:
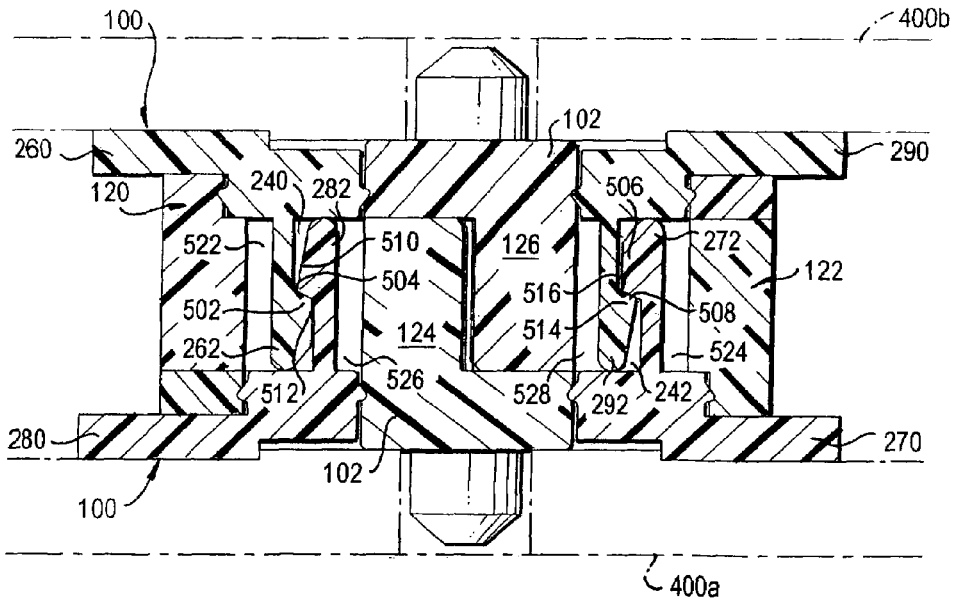
FIG. 5 is an elevational view in section of the electrical connectors illustrated in FIG. 4 taken along line 5—5.

As seen in FIGS. 2 and 5, each of the contacts of the first set of socket contacts 132 includes opposite first and second ends 260 and 262, and each of the contacts of the second set of socket contacts 134 includes first and second ends 270 and 272. Likewise, each of the contacts of the first set of plug contacts 136 includes opposite first and second ends 280 and 282, and each of the contacts of the second set of plug contacts 138 includes opposite first and second ends 290 and 292.

As seen in FIG. 2 and FIGS. 4 and 5 (showing two mated connectors 100), the first ends 260 and 280 of the contacts of the first socket 120 and first plug 124, respectively, extend through the connector main body 102 and extend away from its first side 108. First ends 270 and 290 of the contacts of the second socket 122 and the second plug 126 extend through the main body 102 and extend away from its second side 110 opposite the first side 108. Each of the first ends 260, 270, 280, and 290 of the contacts engage traces on a printed circuit board, thereby electrically connecting each connector 100 to the respective board 400*a* and 400*b*. FIG. 4 shows contact first ends 260 and 280 of the first socket 120 and the first plug 124, respectively, connected to circuit board 400*b*, and contact first ends 270 and 290 of the second socket 122 and the second socket 126 connected to the circuit board 400*a*. Any known attachment can be used to connect the contact ends to the board, such as soldering.

As seen in FIG. 5, the second ends 262 of the first set of socket contacts 132 include a catch 502 with a catching surface 504 for engaging a mating contact. Likewise, the second ends 272 of the second set of socket contacts 134 include a catch 506 with a catching surface 508. Similarly, the second ends 282 and 292 of the first and second sets of plug contacts 136 and 138, respectively, includes a catch 510 and 514, respectively, with catching surfaces 512 and 516. Each of the second ends 262 of the contacts of the first socket 120 rest in individual recesses 522 of the first section 208 of the L-shaped member 128 and the second ends 272 of the contacts of the second socket 122 rest in individual recesses 524 of the first section 212 of the L-shaped member 130. Each of the second ends 282 of the contacts of the first plug 124 are individually supported in recesses 526 disposed in plug 124. Similarly, each of the second ends 292 of the contacts of the second plug 126 are individually supported in recesses 528 disposed in plug 126. Each of the second ends 262, 272, 282 and 292 of the contacts are preferably resilient and can flex within their individual recesses 522, 524, 526, and 528 when engaging another contact.

To mate the two connectors 100, the second ends 262 of the contacts of the first socket 120, which are exposed in the cavity 240 which receives the first plug 124 of the mating connector 100, engages the second ends 282 of the contacts of the first plug 124 of the mating connector 100 for an electrical connection therebetween. More specifically, the catch 502 of the first socket 120 of one of the connectors 100 engages the catch 510 of the first plug 124 of the other connector 100 so that the catching surfaces 504 and 512 abut one another to electrically connect the two connectors. Because the contacts second ends 262 and 282 are resilient, they flex in their individual recesses 522 and 526 as the catches 502 and 510 engage one another. Likewise the second ends 272 of the contacts of the second socket 122, which are exposed in the cavity 242 and which receives the second plug 126 of the mating connector 100, engages the contact second ends 292 of the second plug 126 of the mating connector. The catch 506 of the second socket 122 of one of the connectors 100 engages the catch 514 of the second plug 126 of the other connector 100 so that the catching surfaces 508 and 516 abut one another. The contact second ends 272 and 292 flex within their individual recesses 524 and 528 as the catches 506 and 514 engage one another.

By fashioning the connector 100 with two identical halves 204 and 206 having alternating socket and plug features, as described above, two connectors 100 can be easily mated to connect two circuit boards 400*a* and 400*b* without regard to mating orientation, that is one connector can be rotated 180° and still mate with the other connector. A latching mechanism (not shown) can be provided on the connector 100 to further secure the connectors together. Moreover, the connector 100 is compact due to the small pitch between the contacts of the sets of contacts 132, 134, 136 and 138 and the arrangement of the first and second sockets 120 and 122 and the first and second plugs 124 and 126.

Figure 6:
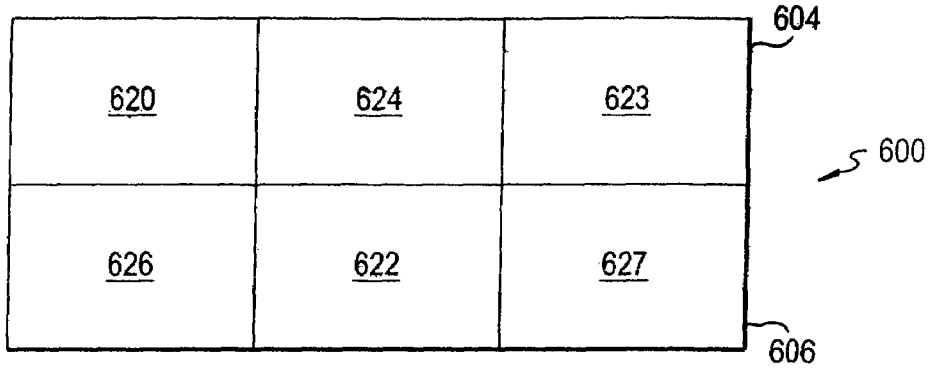
FIG. 6 is a diagrammatical view of a second embodiment of an electrical connector in accordance with the present invention.

FIG. 6 shows a second embodiment of the connector 100. Connector 600 of the second embodiment is similar to connector 100, except that additional plug and socket features are included. Specifically, connector 600 includes first and second sockets 620 and 622 similar to first and second sockets 120 and 122, and first and second plugs 624 and 626 similar to first and second plugs 124 and 126. A third socket 623 and a third plug 624 are added so that each half 604 and 606 of connector 600 includes alternating plug and socket features. The third socket 623 and the third plug 624 can be substantially identical to the sockets 620 and 622 and plugs 624 and 626, respectively.

Figure 7:
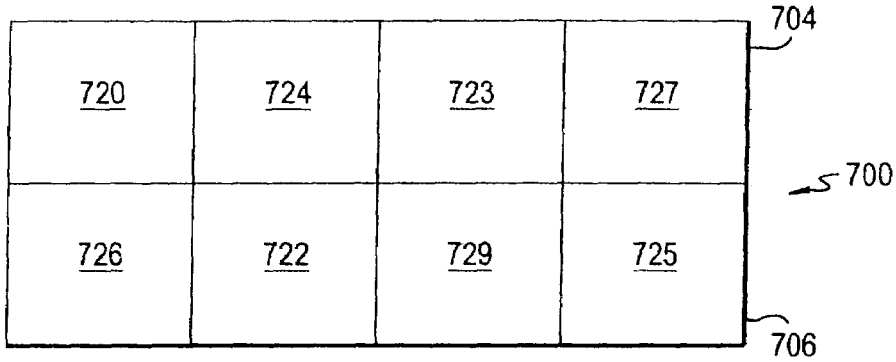
FIG. 7 is a diagrammatical view of a third embodiment of an electrical connector in accordance with the present invention.

FIG. 7 shows a third embodiment connector 700 having first and second halves 704 and 706 with first and second sockets 720 and 722 and first and second plugs 724 and 726 similar to sockets 120 and 122 and plugs 124 and 126 of the connector 100, respectively. Third and fourth sockets 723 and 725 and third and fourth plugs 727 and 729 are added so that each half 704 and 706 includes alternative socket and plug features. Although the embodiments of FIGS. 6 and 7 show three socket and plug features and four socket and plug features, respectively, any number of socket and plug features can be used including a single socket and a single plug.

Figure 8:
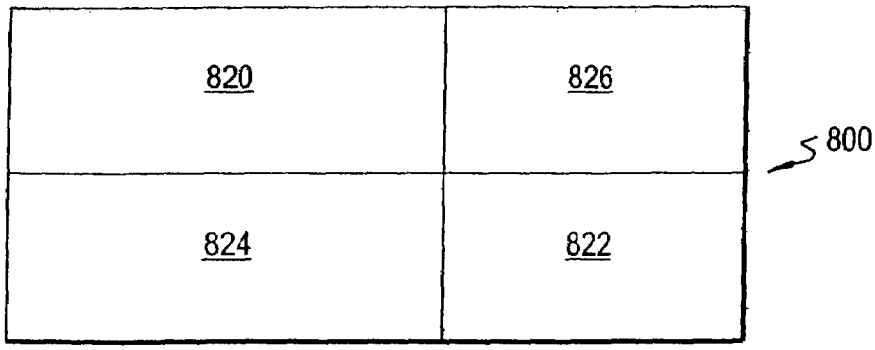
FIG. 8 is a diagrammatical view of a fourth embodiment of an electrical connector in accordance with the present invention.

FIG. 8 shows a fourth embodiment of the connector 100. Connector 800 of the fourth embodiment includes first and second sockets 820 and 822 and first and second plugs 824 and 826. Unlike the sockets 120 and 122 of the connector 100, the sockets 820 and 822 are not identical. For example, the first socket 820 can be larger or longer than the second socket 822 such that the first socket 820 can support more contacts that the second socket 822. Similarly, the first and second plugs 824 and 826 are not identical with the first plug 824 being larger than the second plug 826.

While particular embodiments have been chosen to illustrate the invention, it will be understood by those skilled in the art that various changes and modification can be made therein without departing from the scope of the invention as defined in the appended claims.

What is claimed is:

1. Electrical connector for a printed circuit board, comprising:

a main body including a printed circuit board engaging surface;

a first socket disposed on said main body, said first socket including a first section extending from said main body opposite said printed circuit board engaging surface, and a plurality of first contacts each having opposite first and second ends;

a first plug spaced from said first socket and having a plurality of second contacts each having opposite first and second ends, said first ends of each of said first and second contacts extending in substantially the same direction from a first side of said main body and being adapted to engage the printed circuit board, and each said second ends of said first and second contacts being exposed and including a catching surface for engaging a contact of a mating connector;

a second socket disposed opposite said first plug on said main body so that said exposed second ends of said second contacts of said first plug face away from said second socket; and a second plug disposed opposite said first socket on said main body so that said exposed second ends of said first contacts of said first socket face said second plug.

2. An electrical connector according to claim 1, wherein each of said first and second contacts being resilient; and each of said catching surfaces being disposed on a catch of said respective second ends of said first and second contacts.

3. An electrical connector according to claim 1, wherein said second socket includes a plurality of third contacts, said second plug includes a plurality of fourth contacts, and each of said third and fourth contacts includes a first end extending from a second side of the main body in a direction opposite that of the first and second contacts, said first ends being adapted for engaging the printed circuit board, and an opposite second end exposed and including a catching surface for engaging a mating connector.

4. An electrical connector according to claim 1, wherein said second socket is substantially identical to said first socket; and said second plug is substantially identical to said first plug.

5. An electrical connector according to claim 1, wherein said second socket is not identical to said first socket; and said second plug is not identical to said first plug.

6. An electrical connector according to claim 1, wherein said second socket includes an L-shaped member disposed on a corner of said main body opposite said printed circuit board engaging surface.

7. An electrical connector according to claim 1, wherein said first and second contacts have a pitch that is less than 0.5 mm.

8. An electrical connector according to claim 1, wherein said main body includes first and second alignment posts extending from said printed circuit board engaging surface for engaging corresponding holes in the printed circuit board.

9. An electrical connector according to claim 1, wherein said first socket includes a second section, and said first and second sections of said first socket forming an L-shaped member.

10. An electrical connector according to claim 9, wherein said L-shaped member is disposed at a corner of said main body.

11. An electrical connector assembly, comprising:

first and second printed circuit boards; and first and second substantially identical connectors mounted to said first and second printed circuit boards, respectively, each of said first and second connectors including a main body, and a first socket and a first plug extending from a surface of said main body opposite said respective first and second printed circuit boards, said first socket and said first plug including a plurality of first and second contacts, respectively, each of said first and second contacts including opposite first and second ends, said first ends of said first and second contacts of said first connector extend in substantially the same direction from a first side of said main body of said first connector and engage said first printed circuit board, said first ends of said first and second contacts of said second connector extend in substantially the same direction from a first side of said main body of said second connector and engage said second printed circuit board, said second ends of said first contacts of said first socket of said first connector engaging said second ends of said second contacts of said first plug of said second connector, and said second ends of said second contacts of said first plug of said first connector engaging said second ends of said first contacts of said first socket of said second connector, thereby electrically connecting said first and second printed circuit boards.

12. An electrical connector assembly according to claim 11, wherein each of said first sockets includes an L-shaped member disposed at a corner of said main body of said respective first and second connector; and said L-shaped members support said first contacts.

13. An electrical connector assembly according to claim 11, wherein each of said first and second connectors includes a second socket substantially identical to said first socket and a second plug substantially identical to said first plug.

14. An electrical connector assembly according to claim 11, wherein said first and second contacts have a pitch that is less than 0.5 mm.

15. An electrical connector assembly according to claim 11, wherein each of said main bodies of said first and second connectors include at least one alignment post disposed along a central longitudinal axis of said main body.

16. An electrical connector assembly according to claim 11, wherein each of said first and second connectors includes a second socket disposed opposite said first plug, and a second plug disposed opposite said first socket.

17. An electrical connector assembly according to claim 11, wherein each of said first and second connectors includes a third socket and a third plug disposed opposite said third socket.

18. An electrical connector assembly according to claim 11, wherein each of said second ends of said first and second contacts of said first and second connectors includes a catching surface for engaging the respective second end of said first and second contacts of said first and said connectors.

19. An electrical connector assembly according to claim 18, wherein each of said catching surfaces is disposed on a catch of said respective second ends of said first and second contacts of said first and second connectors.

20. An electrical connector assembly according to claim 11, wherein each of said first and second connectors includes a second socket and a second plug;

said first and second sockets of each of said first and second connectors being disposed on opposite corners of said main body;

said first plug being disposed opposite said second socket; and said second plug being disposed opposite said first socket.

21. An electrical connector assembly according to claim 20, wherein each of said second sockets include a plurality of third contacts;

each of said second plugs include a plurality of fourth contacts; and each of said third and fourth contacts including opposite first and second ends, said first ends of said third and fourth contacts of said first and second connectors engaging said first and second printed circuit boards, respectively, said exposed second ends of said third contacts of said second socket of said first connector engaging said exposed second ends of said fourth contacts of said second plug of said second connector, and said exposed second ends of said fourth contacts of said second plug of said first connector engaging said exposed second ends of said third contacts of said second socket of said second connector.

22. An electrical connector assembly according to claim 20, wherein said exposed second ends of said first contacts of said first socket of each of said first and second connectors face said second plug; and said exposed second ends of a plurality of said third contacts of said second socket of each of said first and second connectors face said first plug.

23. Electrical connector for a printed circuit board, comprising:

a main body including a printed circuit board engaging surface;

a first socket disposed on said main body, said first socket including first and second sections, said first section extending from said main body opposite said printed circuit board engaging surface, said first and second sections of said first socket forming an L-shaped member, and a plurality of first contacts each having opposite first and second ends;

a first plug spaced from said first socket and having a plurality of second contacts each having opposite first and second ends, said first ends of each of said first and second contacts extending in substantially the same direction from a first side of said main body and being adapted to engage the printed circuit board, and each said second ends of said first and second contacts being exposed and including a catching surface for engaging a contact of a mating connector.

24. An electrical connector according to claim 23, wherein said L-shaped member is disposed at a corner of said main body.

* * * * *

UNITED STATES PATENT AND TRADEMARK OFFICE

CERTIFICATE OF CORRECTION

PATENT NO. : 7,182,608 B2
APPLICATION NO. : 11/172935
DATED : February 27, 2007
INVENTOR(S) : Soh et al.

It is certified that error appears in the above-identified patent and that said Letters Patent is hereby corrected as shown below:

Col. 3, line 22, change "22" to --222--.

Signed and Sealed this

Thirty-first Day of July, 2007

JON W. DUDAS
*Director of the United States Patent and Trademark Office*